United States Patent [19]

Stabel

[11] Patent Number: 4,918,673

[45] Date of Patent: Apr. 17, 1990

[54] NEWSPAPER VENDING MACHINE LAST SALE RECORDER

[76] Inventor: Bernard W. Stabel, 1234 S. Elms Rd., Flint, Mich. 48532

[21] Appl. No.: 313,823

[22] Filed: Feb. 23, 1989

[51] Int. Cl.[4] ..... G04B 47/00; G07F 11/00

[52] U.S. Cl. ..... 368/10; 221/2; 221/8

[58] Field of Search ..... 368/9, 10; 221/2, 3, 221/7, 8, 15, 213; 377/20

[56] References Cited

U.S. PATENT DOCUMENTS

| | | | |
|---|---|---|---|
| 4,102,631 | 7/1978 | Goto | 368/10 |
| 4,139,120 | 2/1979 | Moore | 221/213 |
| 4,199,077 | 4/1980 | Lacenell | 221/213 |
| 4,368,030 | 1/1983 | Benedetti | 368/10 |
| 4,389,000 | 6/1983 | Godlet et al. | 221/8 |
| 4,463,348 | 7/1984 | Sidebottom | 368/9 |
| 4,502,788 | 3/1985 | Londen | 368/10 |

*Primary Examiner*—Vit W. Miska

*Attorney, Agent, or Firm*—Donald C. Bolger

[57] ABSTRACT

A time of last sale recording device for a newspaper vending machine. The time recorder uses a proximity sensor to send a signal to a predetermining subtracting counter for each time the vending machine door is opened. One digit is subtracted each time the door is opened (newspaper removed). When the counter goes to zero, the hour meter stops and that is the time of last sale. The data recorded is useful in determining the number of newspapers to leave in the vending machine at future dates. Vending machine sales can be optimized when coupled with other marketing information.

6 Claims, 1 Drawing Sheet

FIG.1
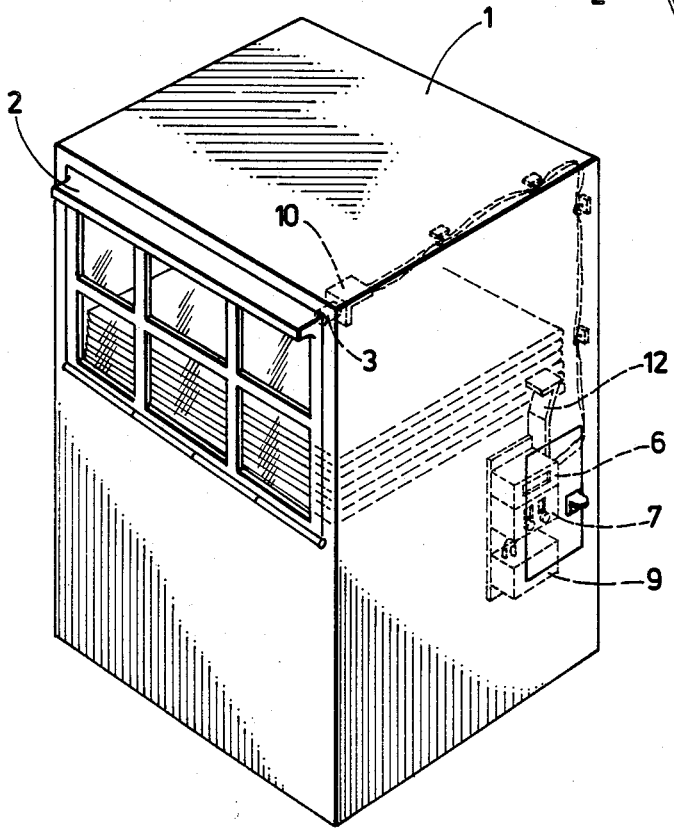
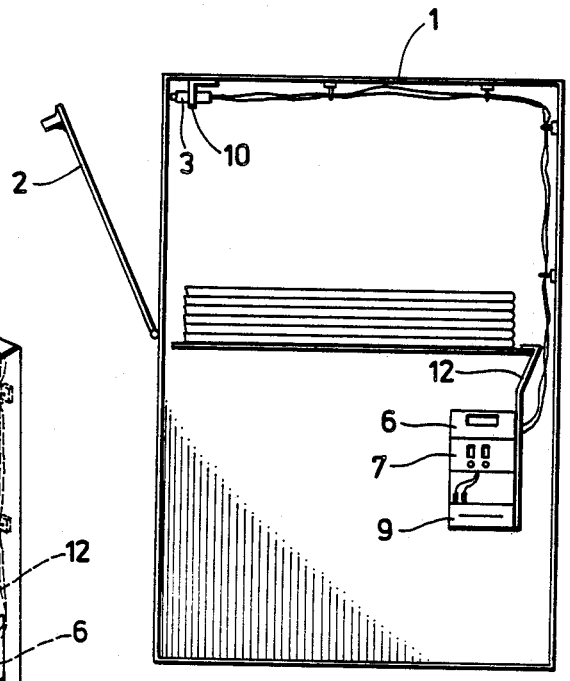
FIG. 2
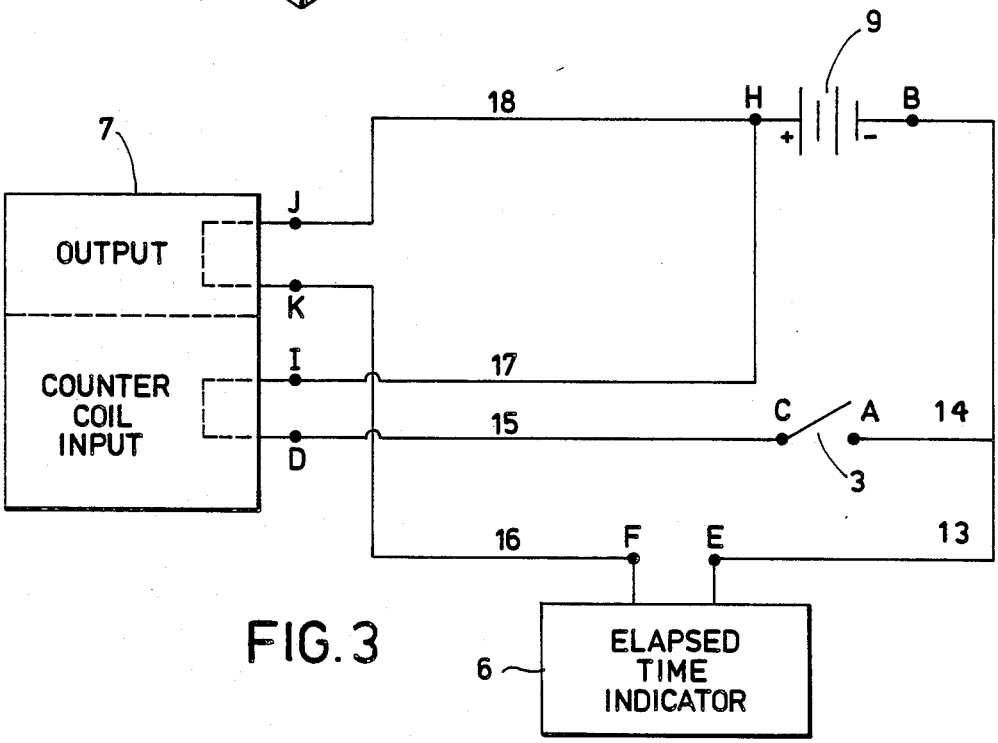
FIG. 3

NEWSPAPER VENDING MACHINE LAST SALE RECORDER

BACKGROUND OF THE INVENTION

The field of the invention is generally that of recording the rate of sales for dispensing and vending apparatus for dispensing newspaper and other similar publications or the like and more specifically an apparatus to determine the last sale or other useful information.

When selling newspapers in newspaper vending machines, running out of newspapers is a long-standing problem. Typically the vendor feels that more newspapers could have been sold, which would result in more income. Therefore, the next day more newspapers are left in the newspaper vending machine to cover the previous days shortage. The vendor has very little data upon which to base his decision. If the vendor leaves only one more paper when many more could be sold, he reduces his income. Also, if he leaves many extra newspapers the next day when only one was required, he may again reduce his income.

Newspaper vendors guess at the required amount of newspapers to leave in the newspaper vending machines each day. If all the newspapers were sold, the vendor will usually leave a few extra each day until unsold newspapers exist. If more than one or two are unsold, the vendor will leave less the next day. The vendor guesses at the amount to leave because the vendor does not know at what time the last paper was sold. They operate by rule of thumb.

SUMMARY OF THE INVENTION

Generally speaking, the present invention comprises a novel method to overcome the above problems. The present invention records the time when the last paper was sold and by noting when the newspapers were placed in the vending machine and at what time the elapsed time indicator was set to zero, the vendor can determine how long it took to sell a certain number of newspapers. This information is then coupled with the characteristics and sell patterns of each tested vending machine to place the correct number of newspapers per day in that particular machine, thus eliminating guesswork.

The present invention works as follows. The operator enters the number of newspapers placed in the vending machine into the predetermining subtractive counter and either starts the timer at zero or sets the time of day, depending on what data is desired. Each time a newspaper is taken from the vending machine, the door to the machine is opened, which is perceived by the sensor. This information is electrically relayed to the predetermining counter (a count-down mode counter), which decreases the count by one. This proceeds till all newspapers have been removed and means the counter is at zero, which stops the elapsed time indicator.

The present invention is also portable so that it can be quickly installed in a particular vending machine for a given time and then easily moved to another vending machine at a different location. This way the vendor does not need a recorder for each vending machine.

It is an object of the present invention to provide a novel means to record the time of the last newspaper sale in a newspaper vending machine.

It is a further object of the invention to provide a novel means to use an elasped time indicator and predetermining counter to record the time of the last sale in a newspaper in vending machine.

Further objects are implicit in the detailed description which follows hereinafter (which is to be considered as exemplary of, but not specifically limiting, the present invention) and said objects will be apparent to persons skilled in the art after a careful study of the detailed description which follows.

For the purpose of clarifying the nature of the present invention, one exemplary embodiment of the invention is illustrated in the hereinbelow-described figures of the accompanying drawings and is described in detail hereinafter. It is to be taken as representative of the multiple embodiments of the invention which lie within the scope of the invention.

BRIEF DESCRIPTION OF THE DRAWING

FIG. 1 is a three-dimensional perspective view showing one exemplary embodiment of one representative form of the time of last sale recorder for a newspaper vending machine.

FIG. 2 is a side view showing one exemplary embodiment of one representative form of the time of last sale recorder for a newspaper vending machine.

FIG. 3 is an electrical circuit diagram showing the electrical connections for the power supply, predetermining subtractive counter, and the elapsed time indicator.

DESCRIPTION OF THE PREFERRED EMBODIMENTS

Referring to FIG. 3, the invention consists of switch 3, elapsed time indicator 6, predetermining subtractive counter 7, and power supply 9. The predetermining subtractive counter 7 is a Model P8-1063-24DC manufactured by Redington Counter, Inc, 130 Addison Road, P.O. Box 608, Windsor, CT 06095; or equivalent. The elapsed time indicator 6 is a Model 6108-4MRC manufactured by Syrelec Corp., 2445 Midway Road, Carrollton, Texas, 75006-2503; or equivalent, however, an interval meter could also be used. Power supply 9 is a 24 DC volt battery or equivalent, however, other voltage could also be used.

Terminal A of switch 3 is electrically connected to terminal B of power supply 9 by wire 14. Terminal C of switch 3 is electrically connected to terminal D of predetermining subtractive counter 7 by wire 15. Terminal E of elapsed time indicator 6 is electrically connected to terminal B of power supply 9 by wire 13. Terminal F of elapsed time indicator 6 is electrically connected to terminal K of predetermining subtractive counter 7 by wire 16. Terminal H of power supply 9 is electrically connected to terminal I of predetermining subtractive counter 7 by wire 17. Terminal H of power supply 9 is electrically connected to terminal J of predermining subtractive counter 7 by wire 18.

Referring to FIG. 1, elapsed time indicator 6 is electrically connected to predetermining subtractive counter 7 and mounted under the newspapers of vending machine 1 by mounting bracket 12. A 24 volt DC power supply 9 is mounted below predetermining subtractive counter 7.

Switch 3 is attached to the top of the vending machine by bracket 10. Switch 3 is adjusted at a set distance from vending machine door 2 so that one electrical signal is sent each time that the door is opened. Switch 3 is electrically connected in series to predetermining subtractive counter.

When vendor machine door 2 is opened, switch 3 closes the series circuit between power supply 9 and predetermining subtractive counter 7 and one number is subtracted from predetermining subtractive counter 7. Later, the data recorded will show at what point in time the last newspaper was sold.

It should be understood that the figures and the specific description thereof set forth in this application are for the purpose of illustrating the present invention and are not to be construed as limiting the present invention to the precise and detailed specific structures shown in the drawing figures and specifically described hereinbefore. Rather, the real invention is intended to include substantially equivalent constructions embodying the basic teachings and inventive concept of the present invention.

What is claimed is:

1. A time counting data collection means for a newspaper vending machine of the type which includes a door which must be opened to gain access to the newspaper comprising:

a switch which is mounted so that the switch is activated by the opening of a newspaper vending machine door;

a predetermining subtractive counter having a counter coil input and an output whereby the counter subtracts one digit each time the counter coil input receives an electrical signal from the switch and whereby the output produces an open circuit when the counter digit is zero;

an elapsed time indicator which measures time when power is applied;

a power supply;

means for electrically connecting the power supply in series with the switch and the counter coil input of the predetermining subtractive counter;

means for electrically connecting the power supply in series with the elapsed time indicator and the output of the predetermining subtractive counter.

2. The time counting data collection means recited in claim 1 wherein the predetermining subtractive counter is resettable.

3. The time counting data collection means recited in claim 1 wherein the elapsed time indicator is resettable.

4. The time counting data collection means recited in claim 1 wherein the switch is a proximity sensor.

5. The time counting data collection means recited in claim 1 wherein the switch is a magnetically activated sensor.

6. The time counting data collection means recited in claim 1 wherein the elapsed time indicator is replaced by an interval meter.

* * * * *